United States Patent [19]

Yu

[11] Patent Number: 4,695,973

[45] Date of Patent: Sep. 22, 1987

[54] REAL-TIME PROGRAMMABLE OPTICAL CORRELATOR

[75] Inventor: Francis T. S. Yu, State College, Pa.

[73] Assignee: The United States of America as represented by the Secretary of the Air Force, Washington, D.C.

[21] Appl. No.: 790,292

[22] Filed: Oct. 22, 1985

[51] Int. Cl.[4] ..... G06G 9/00

[52] U.S. Cl. ..... 364/822; 364/604; 364/819; 364/713; 350/162.13

[58] Field of Search ..... 364/807, 819, 822, 826–827, 364/861, 713, 728, 604; 350/162.11, 162.12, 162.13; 250/550

[56] References Cited

U.S. PATENT DOCUMENTS

| | | | |
|---|---|---|---|
| 3,500,361 | 3/1970 | Cushner | 340/174 |
| 3,639,744 | 2/1972 | Hewitt | 235/181 |
| 3,700,801 | 10/1972 | Dougherty | 364/827 X |
| 3,700,902 | 10/1972 | Buchan | 250/201 |
| 3,739,362 | 6/1973 | Eschelbach | 340/174.1 M |
| 3,872,293 | 3/1975 | Green | 364/827 X |
| 4,097,749 | 6/1978 | Gardner | 250/550 |
| 4,123,142 | 10/1978 | Fleming et al. | 350/162 SF |
| 4,139,897 | 2/1979 | Gardner et al. | 364/827 |
| 4,187,000 | 2/1980 | Constant | 350/162 SF |
| 4,225,938 | 9/1980 | Turpin | 364/822 |
| 4,365,310 | 12/1982 | Green | 364/822 |
| 4,445,141 | 4/1984 | Benton et al. | 358/294 |
| 4,505,544 | 3/1985 | Blodgett et al. | 350/162.13 |
| 4,514,038 | 4/1985 | Pichon et al. | 350/162.13 |
| 4,531,196 | 7/1985 | Lin | 364/827 |
| 4,539,651 | 9/1985 | Ludman | 364/822 |
| 4,647,154 | 3/1987 | Birnbach et al. | 350/162.12 |

OTHER PUBLICATIONS

Bleha; W. P. et al., "Application of the Liquid Crystal Light Valve to Real-Time Optical Data Processing," *Optical Engineering*, vol. 17, No. 4, Jul.-Aug. 1978, pp. 371–384.

Ross, William E. et al., "Two-Dimensional Magneto-Optic Spatial Light Modulator for Signal Processing," *Optical Engineering*, vol. 22, No. 4, Jul./Aug. 1983, pp. 485–490.

Ross, William E. et al., "Two-Dimensional Magneto-Optic Spatial Light Modulator for Signal Processing," *SPIE*, vol. 341, Real Time Signal Processing V, 1982, pp. 191–198.

*Primary Examiner*—Gary V. Harkcom

*Attorney, Agent, or Firm*—Jacob N. Erlich; Donald J. Singer

[57] ABSTRACT

A real-time programmable joint transform optical correlator incorporating a magneto-optic spatial light modulator and a liquid crystal light valve therein. Object functions to be correlated are input into the magneto-optic spatial light modulator by a programmable microcomputer as input signals. Real time correlation takes place at the liquid crystal light valve with a coherent read out beam. Cross correlation between the input functions (signals) are obtained through the inverse Fourier transform of the read out coherent illumination and are subsequently output from the correlator.

18 Claims, 5 Drawing Figures

REAL-TIME PROGRAMMABLE OPTICAL CORRELATOR

STATEMENT OF GOVERNMENT INTEREST

The invention described herein may be manufactured and used by or for the Government for governmental purposes without the payment of any royalty thereon.

BACKGROUND OF THE INVENTION

This invention relates generally to optical correlators, and, more particularly, to a real-time programmable joint transform optical correlator.

In recent years, the acceptance of optical correlation systems has greatly expanded because of their extreme usefulness in the processing of optical signals in, for example, any type of image processing system, optical communication system, radar system, etc. More specifically, the optical correlator can effectively compare a pair of signals (objects) and by an analysis of intensity peaks determine information with respect to these signals (objects).

In 2-D coherent optical correlation, to date, there are two commonly used techniques available; one utilizes the holographic matched filter technique and the other utilizes the joint transformation method. More particularly, the development of the joint transfer correlation technique is headed in two general directions to improve its performance. One is a two-step optical-electrical process, such that the intensity distribution of the joint Fourier transformation of two object functions can be picked up by a TV vidicom camera or by arrays of charge couple device detectors wherein the detected power spectral density is electronically processed to yield the correlation of the two object functions. The other method utilizes a spatial light modulator in the Fourier plane to read out the irradiance of the joint-Fourier transform for coherent processing.

There are numerous drawbacks associated with such prior optical correlation techniques and/or systems. Of primary importance are the drawbacks associated with the lack of acceptable real-time correlation and its inability to perform programmable correlation. Furthermore, such systems as described above are elaborate in design and rely upon the critical alignment of the matched filters incorporated therein. There have been recent attempts at real-time optical correlation, however, such correlation systems still lack programmability while the alignment of the matched filter as well as the synthesis of the filter remain an elaborate procedure.

It would therefore be highly desirable to provide a totally optical technique effective in handling a large space-bandwith image capable of performing parallel multi-image correlations. In addition, it would be desirable if such a correlation technique incorporated therein standard components capable of being designed for use within a compact portable system for real-time programmable correlation.

SUMMARY OF THE INVENTION

The present invention overcomes the problems encountered in the past and as set forth in detail hereinabove by providing a programmable optical correlator which provides real-time optical pattern recognition. In order to effect such a real-time programmable optical correlation, the optical correlator of the present invention utilizes a magneto-optic device such as a programmable magneto-optic spatial light modulator (MOSLM) in conjunction with a liquid crystal light valve (LCLV). The object functions to be correlated are input into the magneto-optic spatial light modulator by means of any suitable conventional programmable microcomputer as input signals. Real-time correlation takes place at the liquid crystal light valve in conjunction with a coherent readout beam. Cross correlation between the input signals can be obtained through the inverse Fourier transform of the readout coherent illumination. This inverse Fourier transform is received at the output plane of the correlator by a conventional charge coupled array detector and TV camera. The detected signals can also be utilized in a feedback circuit to instruct the microcomputer for image programming.

It is therefore an object of this invention to provide an optical correlator which is capable of handling a large space-bandwidth image.

It is another object of this invention to provide an optical correlator capable of performing parallel, multi-image correlations.

It is a further object of this invention to provide an optical correlator which has the capability of performing multi-image cross correlation in real-time.

It is still another object of this invention to provide an optical correlator which has the capability of performing with high optical resolution.

It is still another object of this invention to provide an optical correlator which is simple in design, economical to produce and yet highly reliable in real-time optical pattern recognition.

It is still a further object of this invention to provide an optical correlator which utilizes conventional, currently available components therein that lend themselves to standard mass producing manufacturing techniques.

For a better understanding of the present invention, together with other and further objects thereof, reference is made to the following description taken in conjunction with the accompanying drawings and its scope will be pointed out in the appended claims.

DETAILED DESCRIPTION OF THE PREFERRED EMBODIMENT

Figure 1:
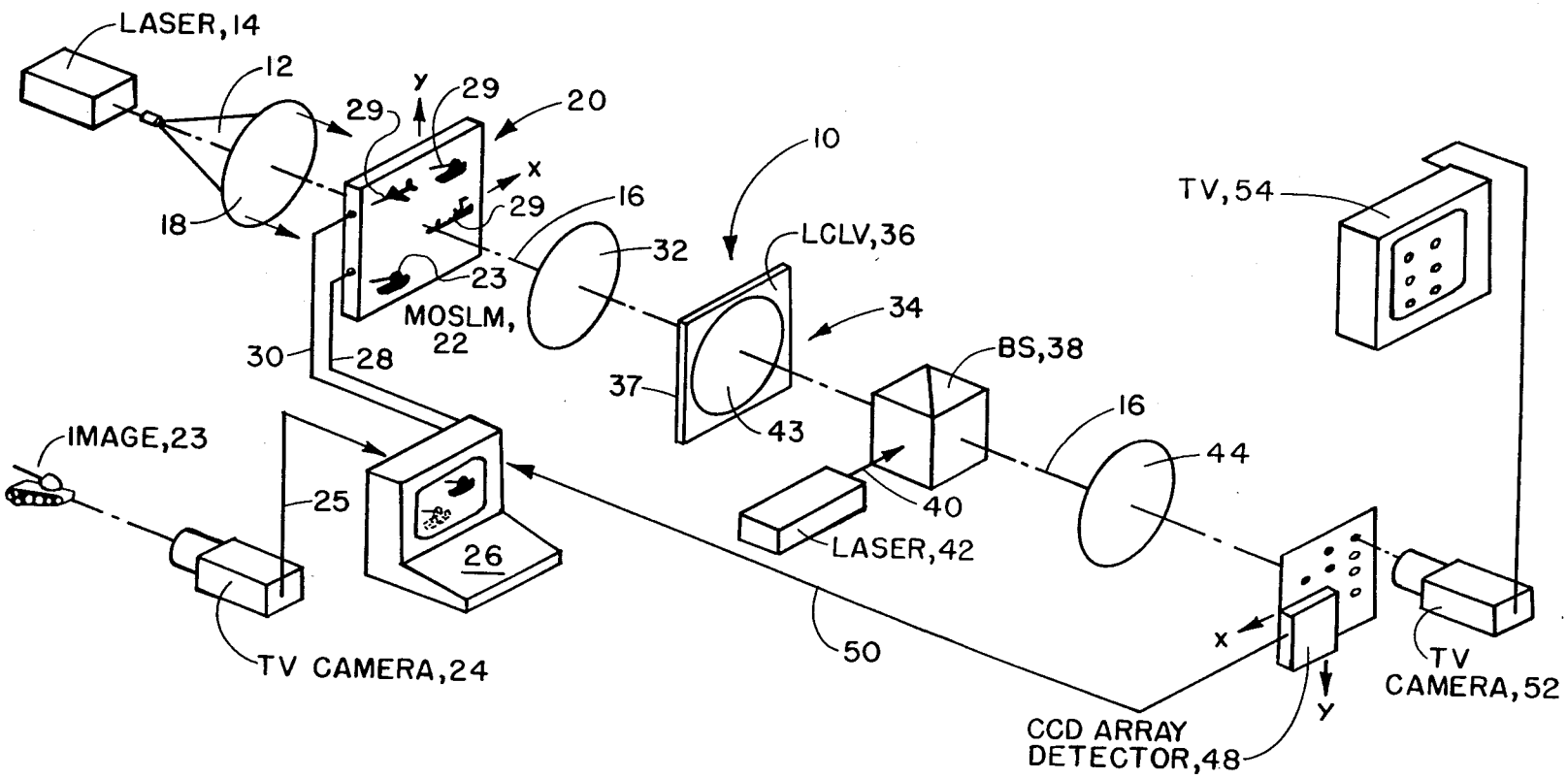
FIG. 1 is a pictorial representation of the real-time programmable optical correlator of the present invention.

Reference is now made to FIG. 1 of the drawings which clearly depicts, in pictorial fashion, the real-time programmable optical correlator 10 of the present invention. As illustrated therein a beam of electromagnetic radiation 12 is provided by any conventional source of electromagnetic radiation such as, for example, an argon or helium-neon laser 14. The power of the laser 14 may vary in range from approximately 2–15 mW and have a wavelength of, for example, 632.8 nm. It should be realized, however, that the above examples of power and wavelength are merely illustrative of an operative embodiment of the present invention, and are not considered limiting with respect to optical correlator 10 of the present invention.

The beam of electromagnetic radiation 12 emitted by laser 14 is directed along a preselected optical axis 16. Optically aligned with beam 12 and coincidental with optical axis 16 are the remaining components of the optical correlator 10 of the present invention.

If necessary, any conventional focusing lens 18 may be positioned adjacent laser 14 in order to focus beam 12 to image on input plane 20. In the present invention, situated at input plane 20 is a conventional magneto-optic spatial light modulator (MOSLM) 22 of the type described, for example, in the following articles: Ross, W. E. et al, "Two-dimensioned magneto-optic optical light modulator for signal processing," SPIE, 341, 1982, pp 191–198 and Ross, W. E. et al, "Two-dimensioned magneto-optic spatial light modulator for signal processing," *Opt. Eng.*, 22, 1983, 485–490.

A typical magneto-optic spatial light modulator 20 of the type utilized within the present invention is made up of a layer of magnetic iron-garnet thin film deposited on a transparent nonmagnetic substrate. The layer of nongarnet is subdivided into n×n arrays of bistable pixels, and each of the pixels can be electronically switched on and off through the Faraday effect by means of a conventional microcomputer.

In the present invention magneto-optic spatial light modulator 20 is utilized as a means for generating coherent images from the input signals received thereby. These input signals take the form of a real-time image (object) such as a tank 23 which may be received by any conventional TV camera 24. The output signal 25 emitted therefrom is processed by any conventional microcomputer 26 such as an Apple II or IBM computer with the corresponding output 28 therefrom being input into the magneto-optic spatial light modulator 22. In addition to the real-time image of object 23, any number of reference images 29 can be generated by computer 26 and output therefrom as signal 30 into magneto-optic spatial light modulator 22.

Spaced one focal length after the input plane 20 is a conventional Fourier transform lens 32 capable of forming at plane 34 a joint Fourier transform of the output from magneto-optic spatial light modulator 22.

Positioned at plane 34 is a conventional liquid crystal light valve (LCLV) 36 of the type set forth, for example, in the article by Bleha, W. P. et al, "Application of the Liquid Crystal Light Valve to Real-Time Optical Data Processing," *Opt. Eng.*, 17, 1978, pp 371–384. The liquid crystal light valve 36 receives on its input side or end 37 the joint Fourier transform of the output signals from the magneto-optic spatial light modulator 22. The liquid crystal light valve 36 converts this joint Fourier transform into a coherent power spectrum.

Stated more succinctly, liquid crystal light valve 36 is positioned at the Fourier transform plane 34 in order to convert the incoming Fourier spectra, (i.e the Fourier spectra of the images generated by the MOSLM 22) to a power spectral distribution at the output side or end 43 of LCLV 36.

Situated along optical axis 16 and optically aligned with liquid crystal light valve 36 is a conventional beam splitter 38. Beam splitter 38 directs a beam 40 of coherent electromagnetic radiation emanating from any suitable source of electromagnetic radiation such as a laser 42 onto the output side 43 of liquid crystal light valve 36. A typical laser 42 which could be incorporated in this invention would be similar to the argon or helium-neon laser 14 described above, although it need not be limited thereto.

The beam of electromagnetic radiation 40 emanating from laser 42 is directed by beam splitter 38 onto the output side 43 of the liquid crystal light valve 36. The resultant coherent power spectrum emanating from the output side 43 of the liquid crystal light valve 36 passes through the beam splitter 38 and is directed to pass through a conventional inverse Fourier transform lens 44 situated coincidental with with the optical axis 16 of optical correlator 10 as shown in FIG. 1 of the drawings. The inverse Fourier transform lens 44 is a lens which is substantially identical to lens 32 except that in operation the coordinates are inverted. Lens 44 takes the inverse Fourier transform of the output from the liquid crystal light valve 36 and forms an inverse Fourier transform thereof at the output plane 46. This inverse Fourier transforms is received at output plane 46 by a conventional charge coupled device (CCD) array detector 48.

The movement of detector 48 is in the X and Y coordinates and its output can be directed via feedback line 50 into microcomputer 26 for easy processing and image programming. In addition, a TV camera 52 is located adjacent the output plane 46 so as to provide a visual indication of the correlation of the input signals for subsequent viewing through any conventional TV receiver 54.

In order to more clearly understand the operation of the optical correlator 10 of the present invention let us consider K object functions generated by the magneto-optic spatial light modulator 22 at the input plane 20 to be represented by the following equation:

$$f(x, y) = \sum_{k=1}^{K} f_k(x - a_k, y - b_k), \tag{1}$$

where $a_k$, $b_k$, are positions of the image functions. Since the MOSLM has an inherent grating structure, the amplitude transmittance function of the encoded MOSLM would be $$t(x,y) = f(x,y)g(x,y), \tag{2}$$

where g(x,y) represents a 2-D grating structure of the MOSLM. The corresponding joint Fourier transform at the input end of the LCLV can be written as, $$T(u, v) = F(u, v)*G(u, v) \tag{3}$$

$$= \frac{1}{\lambda^2 f^2}\left(\frac{d}{l}\right)^2 \sum_{m,n} \mathrm{Sinc}\left(m\frac{d}{l}\right) \mathrm{Sinc}\left(n\frac{d}{l}\right) \cdot$$

$$\sum_{k=1}^{K} F_k\left(u - \frac{m}{l},\right.$$

$$\left. v - \frac{n}{l}\right) \exp\left\{-i2\pi\left[a_k\left(u - \frac{m}{l}\right) + b_k\left(v - \frac{n}{l}\right)\right]\right\},$$

where $$G(u, v) = \frac{1}{\lambda^2 f^2}\left(\frac{d}{l}\right)^2 \sum_{m,n} \mathrm{Sinc}(du)\mathrm{Sinc}(dv)\delta\left(u - \frac{m}{l}, v - \frac{n}{l}\right), \quad (4)$$

and $$F(u, v) = \sum_{k=1}^{K} F_k(u, v)\exp[-i2\pi(ua_k + vb_k)], \quad (5)$$

$u=\alpha/(f\lambda)$, $v=\beta/(f\lambda)$ are the spatial frequency coordinates, $(\alpha, \beta)$ are the spatial coordinate system of the Fourier plane, f is the focal length of the transform lens, l is the period of the inherent grating structure of the MOSLM, d is the pixel size, and $\lambda$ is the wavelength of the light source. The corresponding irradiance is therefore, $$|T(u, v)|^2 = \left(\frac{d}{f\lambda l}\right)^4 \sum_{m,n} \mathrm{Sinc}^2\left(m\frac{d}{l}\right) \mathrm{Sinc}^2\left(n\frac{d}{l}\right) \cdot \left[\sum_{k=1}^{K}\left|F_k\left(u - \frac{m}{l}, v - \frac{n}{l}\right)\right|^2 + \sum_{\substack{j,k\\ j\neq k}}^{K}\left[F_jF_k^* \exp\left\{-i2\pi\left[(a_j - a_k)\left(u - \frac{m}{l}\right) + (b_j - b_k)\left(v - \frac{n}{l}\right)\right]\right\} + F_j^*F_k\exp\left\{12\pi\left[(a_j - a_k)\left(u - \frac{m}{l}\right) + (b_j - b_k)\left(v - \frac{n}{l}\right)\right]\right\}\right]\right. . \quad (6)$$

Now, if the output end of the LCLV is illuminated by a beam 40 of coherent light, as shown in FIG. 1, the complex amplitude distribution of the reflected light field would be $$A(u,v)=C_o+C|T(u,v)|^2, \quad (7)$$

where $C_o$ and C are the appropriate proportionality constants. The complex light field at the output plane of the POC is $$a(x,y)=C_o\delta(x,y)+c\mathfrak{F}^{-1}[|T(u,v)|^2], \quad (8)$$

where $$\mathfrak{F}^{-1}[|T(u, v)|^2] = \sum_{m,n} \mathrm{Sinc}^2\left(m\frac{d}{l}\right) \mathrm{Sinc}^2\left(n\frac{d}{l}\right) \cdot \left\{\sum_{k=1}^{K} \mathfrak{F}^{-1}[|F_k|^2 + \sum_{\substack{j,k\\ j\neq k}}^{K} \mathfrak{F}^{-1}\left[F_jF_k^*\exp\left\{\left(-i2\pi\left[\left((a_j - a_k)\left(u - \frac{m}{l}\right) + (b_j - b_k)\left(v - \frac{n}{l}\right)\right]\right\}\right] + \sum_{\substack{j,k\\ j\neq k}}^{K} \mathfrak{F}^{-1}\left[F_j^*F_k\exp\left\{i2\pi\left[(a_j - a_k)\left(u - \frac{m}{l}\right) + (b_j - b_k)\left(v - \frac{n}{l}\right)\right]\right\}\right]\right\}. \quad (9)$$

By a straightforward calculation, Eq. (8) can be written as $$a(x, y) = C_o\delta(x, y) + C\sum_{m,n} \mathrm{Sinc}^2\left(m\frac{d}{l}\right) \mathrm{Sinc}^2\left(n\frac{d}{l}\right) \exp\left[-i2\pi\left(m\frac{x}{l} + n\frac{y}{l}\right)\right] \sum_{k}^{k} R_{kk}(x, y) + C\sum_{m,n} \mathrm{Sinc}^2\left(m\frac{d}{l}\right) \mathrm{Sinc}^2\left(n\frac{d}{l}\right) \exp\left[-i2\pi\left(m\frac{x}{l} + n\frac{y}{l}\right)\right] \cdot \sum_{\substack{j,k\\ j\neq k}}^{K} \{R_{jk}[x - (a_j - a_k), y - (b_j - b_k)] + R_{kj}[x + (a_j - a_k), y + (b_j - b_k)]\}, \quad (10)$$

where $$R_{kk}(x, y) \triangleq \mathfrak{F}^{-1}\{F_kF_k^*\} = \int\int f_k(\xi,n)f_k^*(\xi - x,\eta - y)d\xi d\eta, \quad (11)$$

$$R_{jk} \triangleq \mathfrak{F}^{-1}[F_jF_k\exp\{-i2\pi[(a_j - a_k)u + (b_j - b_k)v]\}] = \int\int f_j(\xi,\eta)f_k^*\{\xi - [x - (a_j - a_k)], \eta - [y - (b_j - b_k)]\}d\xi d\eta, \quad (12)$$

and $$R_{kj} \triangleq \int\int f_k(\xi,n)f_j^*\{\xi - [x + (a_j - a_k)], \eta - [y + (b_j - b_k)]\}d\xi d\eta. \quad (13)$$

It is to be noted that, the first three terms of Eq. (10) are the zero-order terms which would be diffracted around the origin of the output plane, and the last two terms represents the cross correlation terms which will be diffractal around $x=a_j-a_k$, $y=b_j-b_k$, and $x=-(a_j-a_k)$, $y=-(b_j-b_k)$ respectively, in the output plane.

It is apparent that if the jth object function is identical to the kth object function, two autocorrelation functions would be diffracted at $x=a_j-a_k$, $y=b_j-b_k$ and $x=-(a_j-a_k)$, $y=-(b_j-b_k)$, i.e., $$R[x-(a_j-a_k), y-(b_j-b_k)] \quad (14)$$

and $$R[x+(a_j-a_k), y+(b_j-b_k)]. \quad (15)$$

In order to insure non-overlapping cross correlation distributions at the output plane, the separation between the object functions should be $$|a_k - a_j| > KW_x, \tag{16}$$

or $$|b_k - b_j| > KW_y, \tag{17}$$

and $$||a_{j1} - a_{k1}| - |a_{j2} - a_{k2}|| > 2W_x, \tag{18}$$

or $$||b_{j1} - b_{k1}| - |b_{j2} - b_{k2}|| > 2W_y, \tag{19}$$

where $W_x$ and $W_y$ denote the spatial extensions of the image function in the x and the y direction respectively, K is the total number of the input object functions, and the subscripts 1 and 2 represent the locations of two adjacent image functions.

Figure 2:
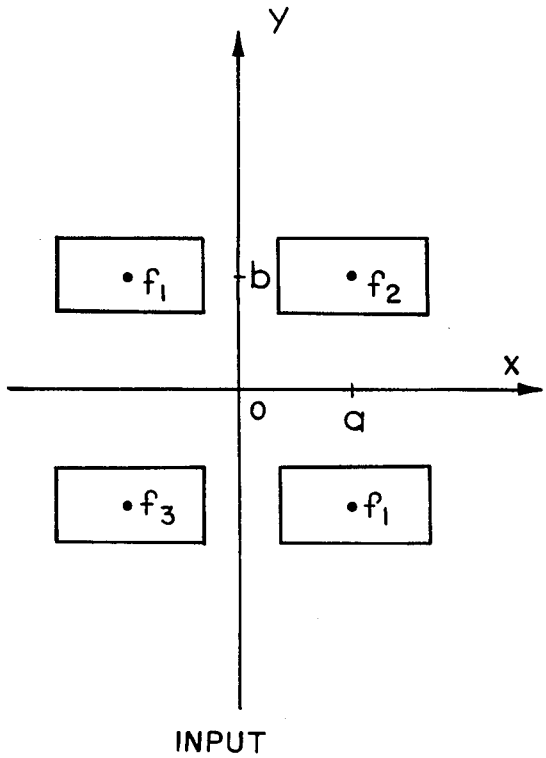
FIG. 2 is a graphic representation of a typical input object function utilized with the optical correlator of this invention.

As an illustration, consider four input image functions (e.g., patterns) generated by the MOSLM shown in FIG. 2 can be expressed as $$f_1(x+a, y-b),\ f_2(x-a, y-b),\ f_3(x+a, y+b), \text{ and } f_1(x-a, y+b). \tag{20}$$

Then the output light field of the PJTC can be explicitely written as $$a(x,y) = \text{autocorrelations} + \text{crosscorrelations} + \text{zero-order terms}, \tag{21}$$

where the autocorrelation terms are $$C \sum_{m,n} \text{Sinc}^2\left(m\frac{d}{l}\right) \text{Sinc}^2\left(n\frac{d}{l}\right) \exp\left[-i2\pi\left(m\frac{x}{l} + n\frac{y}{l}\right)\right] [R_{11}(x-2a, y+2b) + R_{11}(x+2a, y-2b)] = \overline{R}_{11}(x-2a, y+2b) + \overline{R}_{11}(x+2a, y-2b).$$

the crosscorrelation terms are $$\overline{R}_{12}(x+2a, y) + \overline{R}_{12}(x, y+2b) + \overline{R}_{21}(x-2a, y) + \overline{R}_{21}(x, y-2b) + \overline{R}_{13}(x, y-2b) + \overline{R}_{13}(x-2a, y) + \overline{R}_{31}(x, y+2b) + \overline{R}_{31}(x+2a, y) + \overline{R}_{23}(x-2a, y-2b) + \overline{R}_{32}(x+2a, y+2b),$$

the zero-order terms are $$C_o\delta(x,y) + 2\overline{R}_{11}(x,y) + \overline{R}_{22}(x,y) + \overline{R}_{33}(x,y).$$

and $$\overline{R}_{jk} \triangleq C \sum_{m,n} \text{Sinc}^2\left(m\frac{d}{l}\right) \text{Sinc}^2\left(n\frac{d}{l}\right) \exp\left[-i2\pi\left(m\frac{x}{l} + n\frac{y}{l}\right)\right] R_{jk}.$$

Figure 3:
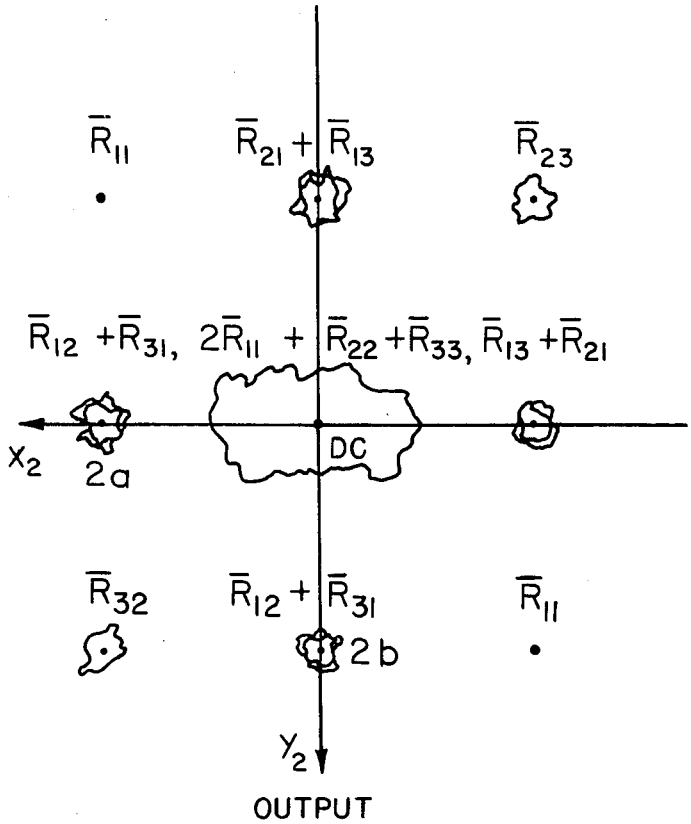
FIG. 3 is a graphic representation of a typical output correlation distribution (overlapping distribution) effected by the optical correlator of this invention.
Figure 4:
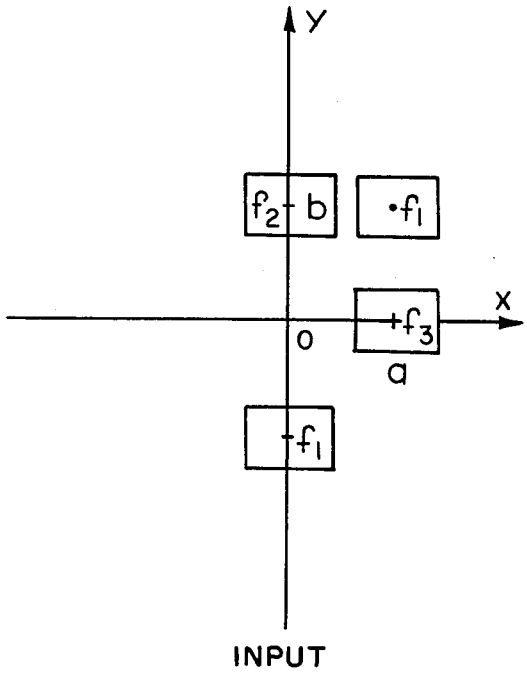
FIG. 4 is a graphic representation of another input object function utilized with the optical correlator of this invention.
Figure 5:
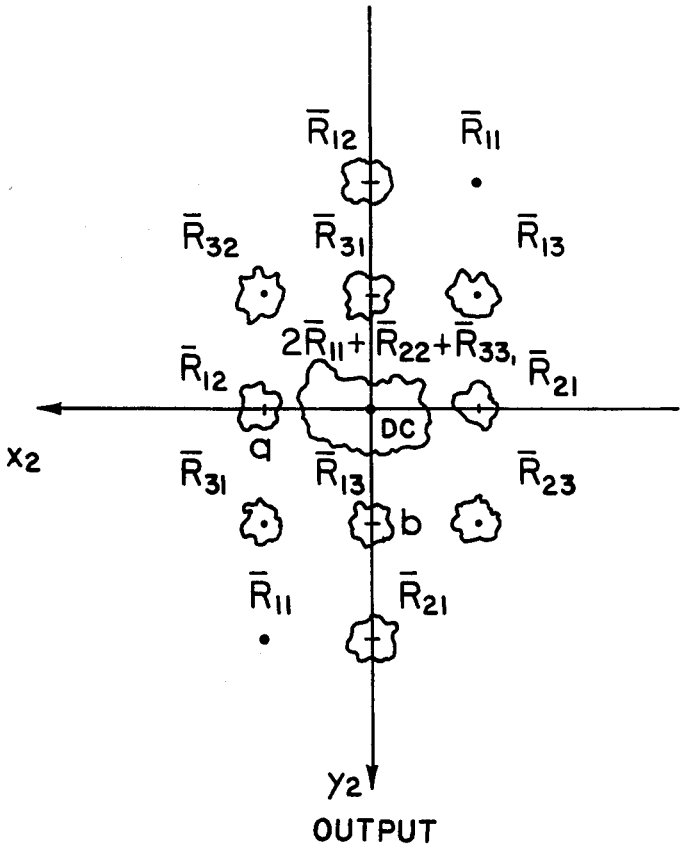
FIG. 5 is a graphic representation of a typical output correlation distribution (non overlapping distribution) effected with the optical correlator of this invention.

A sketch of this output distribution is shown in FIG. 2. Thus, the two first-order autocorrelations (i.e., $\overline{R}_{11}$) were exclusively diffracted away from all the other cross correlation distributions that includes the zero-order diffractions. In view of FIG. 3, note that some of the cross correlation distributions were actually overlapped. In order to avoid the cross overlapping distribution, the image patterns generated by the MOSLM can be set in different locations, such as $f_1(a,b)$, $f_2(a,b)$, $f_3(a,o)$, $f_4(o,-b)$, as shown in FIG. 4, where it is assumed that the lower $f_1(a,b)$ is a real-time image scent pick-up by the TV camera. Thus, as shown in FIG. 5, all the first-order correlation distributions can be made mutually separated.

Although four image functions (that is, patterns) are illustrated in FIGS. 2–5 of the drawings with respect to optical correlator 10 of the present invention, the number or size of the image functions can be increased by using a larger size magneto-optic spatial light modulator 22, or, perhaps, two or more such magneto-optic spatial light modulators at the input plane 20.

Additionally, since the write in-erase time of the magneto-optic spatial light modulator 22 and the liquid crystal light valve 36 are in the order of 20 msec. and <1 msec., respectively, the speed of the processing rate of the optical correlator 10 of this invention depends upon the write in-erase time of the liquid crystal light valve 36. A typical write in-erase time of a conventional magneto-optic spatial light modulator and liquid crystal light valve are set forth as follows:

| | Write in time | Erase time |
|---|---|---|
| MOSLM | ≅1 msec. | ≅1 msec. |
| LCLV | ≅5 msec. | ≅15 msec. |

The resolution of currently available magneto-optic spatial light modulators and liquid crystal light valves are about 14 lines/mm and 30 lines/mm, respectively, measured at the 50% modulation transfer function. Consequently the resolution of the overall system is dependent upon the particular magneto-optic spatial light modulator utilized. Even if we assume a 50% resolution reduction for the overall performance of the optical correlator 10, which would correspond to a resolution of about 7 lines/mm, the resultant output would be of high quality and produce a high quality image correlation. It is therefore clearly evident that the optical correlator 10 of the present invention alleviates many of the disadvantages and difficulties associated with optical correlators of the past.

Although this invention has been described with reference to a particular embodiment, it will be understood that this invention is also capable of further and other embodiments within the spirit and scope of the appended claims.

I claim:

1. A real-time programmable optical correlator, comprising:

means for providing a first beam of electromagnetic radiation and directing said beam of electromagnetic radiation along a preselected optical axis;

means located at a first preselected location along said optical axis for receiving said first beam of electromagnetic radiation, a first input signal and a second input signal and for generating images representative of said first and said second input signals;

means at a second preselected location along said optical axis for receiving said images and forming a joint Fourier transform of said images at a third preselected location along said optical axis;

means for providing a second beam of electromagnetic radiation and directing said second beam of electromagnetic radiation to said third preselected location along said optical axis;

means positioned at said third preselected location along said optical axis for receiving said joint Fourier transform of said images and said second beam of electromagnetic radiation and for generating a coherent power spectrum representative of said images;

means positioned at a fourth preselected location along said optical axis for forming an inverse Fourier transform of said coherent power spectrum of said images at a fifth preselected location along said optical axis, said inverse Fourier transform being representative of a correlation between said first and said second input signals.

2. A real-time programmable optical correlator as defined in claim 1 further comprising means located adjacent said fifth preselected location for detecting said inverse Fourier transform and emitting an output representative of said correlation between said first and said second input signals.

3. A real-time programmable optical correlator as defined in claim 2 further comprising means operably connected to said means located at said first preselected location for receiving an image of an object and for generating said first input signal representative thereof and for generating said second input signal.

4. A real-time programmable optical correlator as defined in claim 3 further comprising means for operably interconnecting said output with said means for generating said first and said second input signals.

5. A real-time programmable optical correlator as defined in claim 3 wherein said means for generating said first and said second input signals comprises a computer.

6. A real-time programmable optical correlator as defined in claim 2 wherein said means located adjacent said fifth preselected location comprises a charge coupled array detector and a television camera.

7. A real-time programmable optical correlator as defined in claim 1 wherein said means located at said first location comprises a magneto-optic spatial light modulator.

8. A real-time programmable optical correlator as defined in claim 7 wherein said means positioned at said third preselected location comprises a liquid crystal light valve.

9. A real-time programmable optical correlator as defined in claim 8 further comprising means located adjacent said fifth preselected location for detecting said inverse Fourier transform and emitting an output representative of said correlation between said first and said second input signals.

10. A real-time programmable optical correlator as defined in claim 9 further comprising means operably connected to said means located at said first preselected location for receiving an image of an object and for generating said first input signal representative thereof and for generating said second input signal.

11. A real-time programmable optical correlator as defined in claim 10 further comprising means for operably interconnecting said output with said means for generating said first and said second input signals.

12. A real-time programmable optical correlator as defined in claim 11 wherein said means for generating said first and said second input signals comprises a computer.

13. A real-time programmable optical correlator as defined in claim 12 wherein said means for providing said first beam of electromagnetic radiation comprises a laser.

14. A real-time programmable optical correlator as defined in claim 13 wherein said means for providing said second beam of electromagnetic radiation and for directing said second beam comprises a laser and a beamsplitter.

15. A real-time programmable optical correlator as defined in claim 14 wherein said means located adjacent said fifth preselected location comprises a charge coupled array detector and television camera.

16. A real-time programmable optical correlator as defined in claim 1 wherein said means positioned at said third preselected location comprises a liquid crystal light valve.

17. A real-time programmable optical correlator as defined in claim 1 wherein said means for providing said first beam of electromagnetic radiation comprises a laser.

18. A real-time programmable optical correlator as defined in claim 1 wherein said means for providing said second beam of electromagnetic radiation and for directing said second beam comprises a laser and a beamsplitter.

* * * * *